US007367862B2

(12) United States Patent
Tsai

(10) Patent No.: US 7,367,862 B2
(45) Date of Patent: May 6, 2008

(54) FIRECRACKER SIMULATING DEVICE

(76) Inventor: Jung Te Tsai, No. 21-3, Zhongxing Street, Qingshui Town, Taichung Hsien 436 (TW)

( * ) Notice: Subject to any disclaimer, the term of this patent is extended or adjusted under 35 U.S.C. 154(b) by 375 days.

(21) Appl. No.: 11/011,817

(22) Filed: Dec. 14, 2004

(65) Prior Publication Data

US 2008/0081537 A1 Apr. 3, 2008

(51) Int. Cl.
*A63H 5/04* (2006.01)

(52) U.S. Cl. ..... 446/397; 446/220; 446/398

(58) Field of Classification Search ..... 446/397, 446/398, 418, 220
See application file for complete search history.

(56) References Cited

U.S. PATENT DOCUMENTS 1,675,110 A * 6/1928 Kempien ..... 40/216
3,357,128 A * 12/1967 Geiser ..... 446/181
5,029,851 A * 7/1991 Hagen ..... 273/458
5,222,740 A * 6/1993 Wu et al. ..... 273/371
5,772,489 A * 6/1998 Sherer et al. ..... 446/14
6,402,582 B1 * 6/2002 Sherer ..... 446/220

* cited by examiner

*Primary Examiner*—John A. Ricci
(74) *Attorney, Agent, or Firm*—Rosenberg, Klein & Lee

(57) ABSTRACT

A firecracker simulating device includes a plate, an actuating device attached to the plate and extended outwardly from the plate, a number of balloons are strung together, and a forcing device may be used for forcing the balloons to engage with the actuating device, to have the balloons to be pierced by the actuating device, and to generate sounds of explosion. The balloons may be strung together with a wire. The wire may be engaged through an opening of the plate and pulled by the users. A bar may be attached to the plate, for attaching the plate to supporting members, and includes a ring, the wire may be engaged through the ring. A weight member or a flag may be attached to the wire.

7 Claims, 4 Drawing Sheets

FIRECRACKER SIMULATING DEVICE

BACKGROUND OF THE INVENTION

1. Field of the Invention

The present invention relates to a firecracker simulating device, and more particularly to a firecracker simulating device for generating explosion or firing of firecrackers without generating smoke or gunpowder and dirt.

2. Description of the Prior Art

Typical firecrackers comprise explosive charges or dynamite disposed therein which are dangerous and which may have a good chance to be exploded or fired inadvertently by fire or even by sun shine. In addition, after explosion or firing, poisonous niter, or smoke of gunpowder, and/or sulphur materials, carbon chips, and paper chips may be generated, which may pollute our environment, and/or may hurt people.

Due to the dangerous explosive charges or dynamite, and due to the explosive characteristics, the typical firecrackers have been banned in many countries. However, explosion or firing of the firecrackers is normally required for ceremonies.

For avoiding the poisonous niter, or smoke of gunpowder, and/or sulphur materials, carbon chips, and paper chips, an electric firecracker simulating device has been developed and includes a tape recorded explosion or firing of the firecrackers, which may be selectively played by users. However, people may not feel the explosion or firing of the firecrackers with the tape recorded explosion or firing of the firecrackers.

The present invention has arisen to mitigate and/or obviate the afore-described disadvantages of the conventional firecracker simulating devices.

SUMMARY OF THE INVENTION

The primary objective of the present invention is to provide a firecracker simulating device for generating explosion or firing of firecrackers without generating smoke or gunpowder and without generating dirt.

In accordance with one aspect of the invention, there is provided a firecracker simulating device comprising a plate including an actuating device attached thereto and extended outwardly therefrom, a plurality of balloons strung together, and a forcing device for forcing the balloons to engage with the actuating device, to have the balloons to be pierced by the actuating device, and to generate sounds of explosion.

The balloons may be strung together with the forcing device, such as a wire. The plate includes an opening formed therein, the wire may be engaged through the opening of the plate.

A bar may further be provided and attached to the plate, for attaching the plate to supporting members. The bar includes a ring attached thereto, the wire is engaged through the ring. The bar includes at least one rod extended therefrom and secured to the plate.

A weight member may further be provided and attached to the wire. The weight member may be a flag, for example. One or more ribbons may further be provided and attached to the plate, and dependent from the plate, and engaged with the balloons, to retain the balloons in place.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 2:
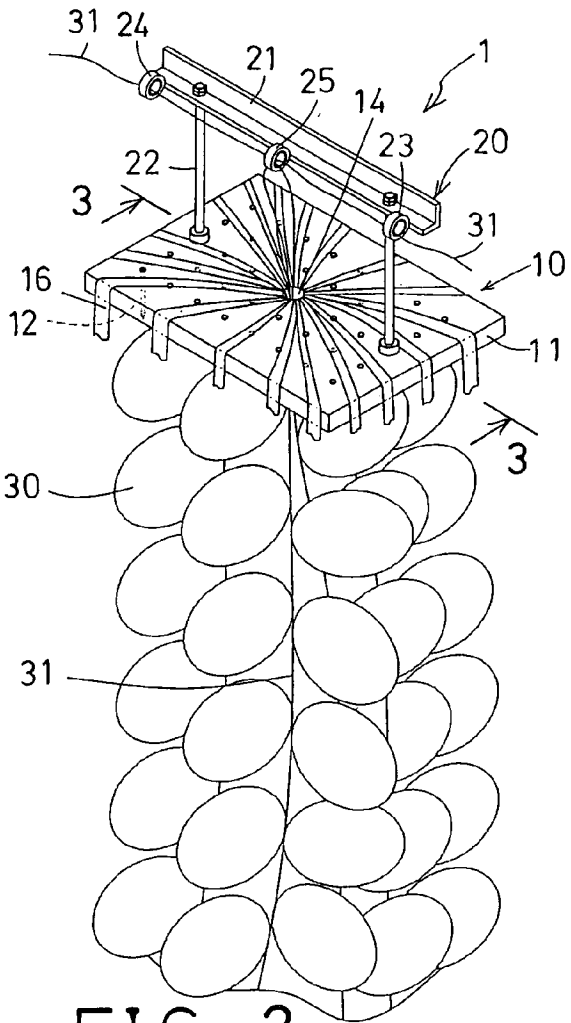
FIG. 2 is another partial perspective view of the firecracker simulating device.
Figure 1:
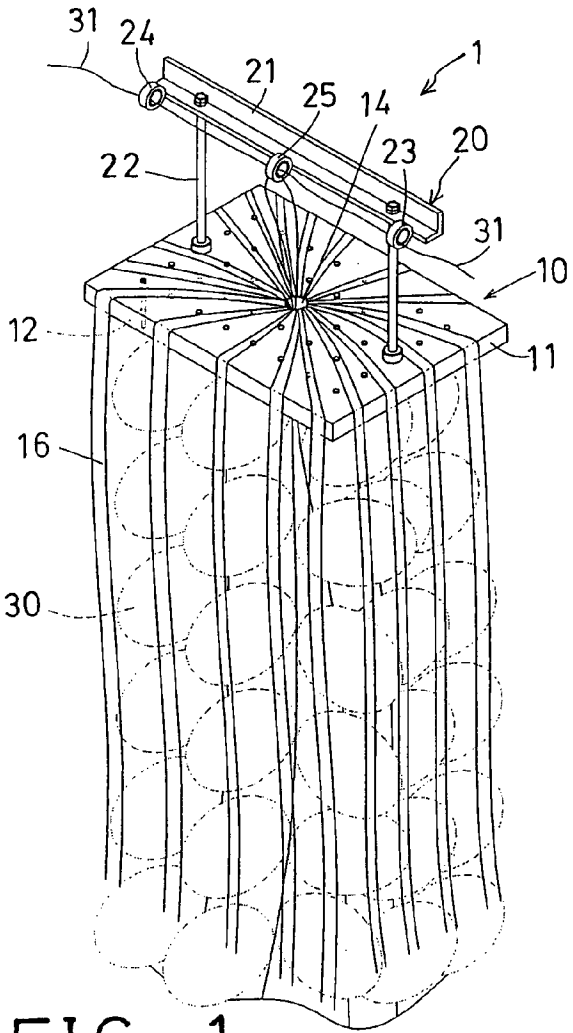
FIG. 1 is a partial perspective view of a firecracker simulating device in accordance with the present invention.
Figure 3:
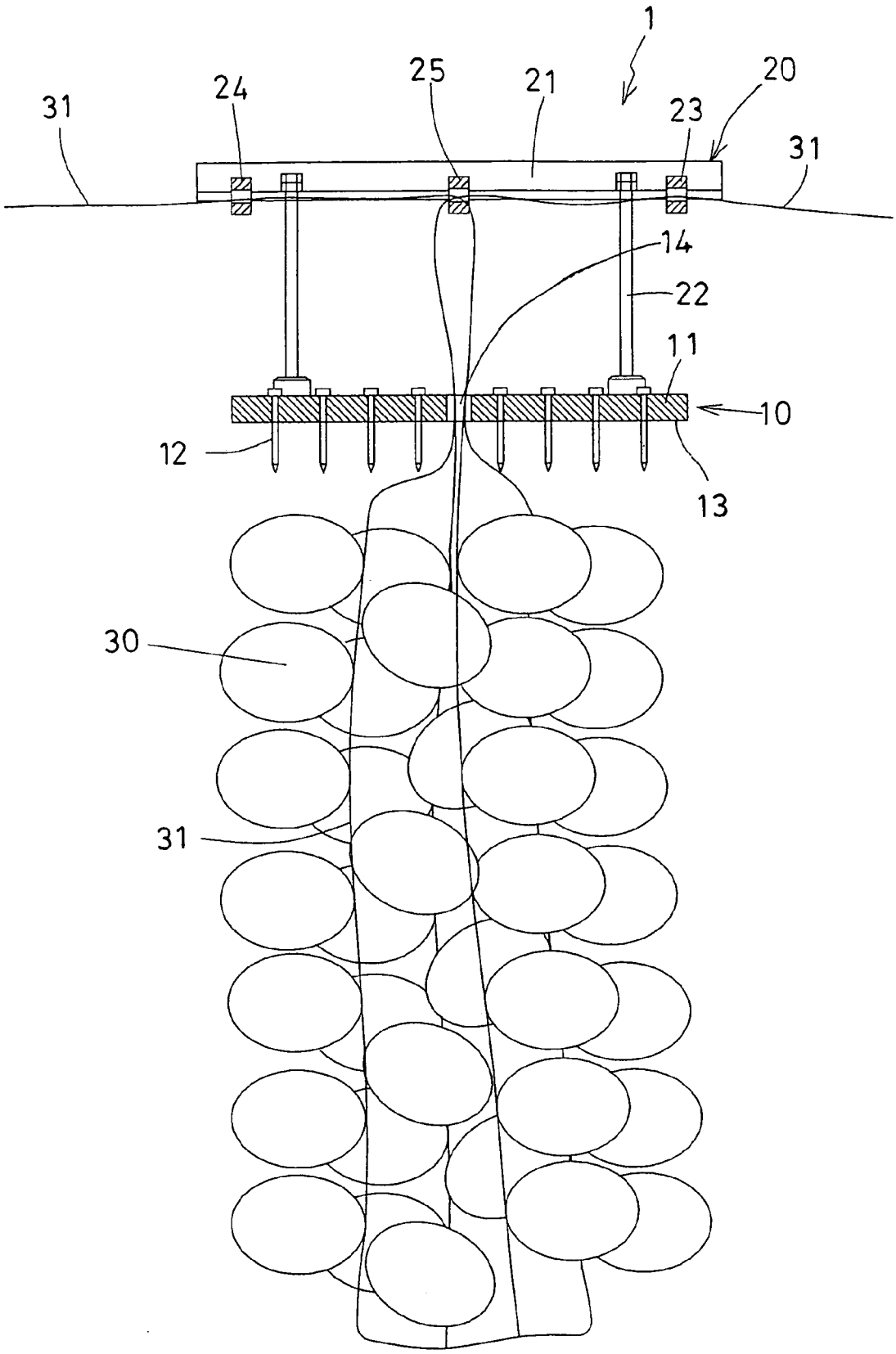
FIG. 3 is a partial cross sectional view of the firecracker simulating device, taken along lines 3-3 of FIG. 2.
Figure 4:
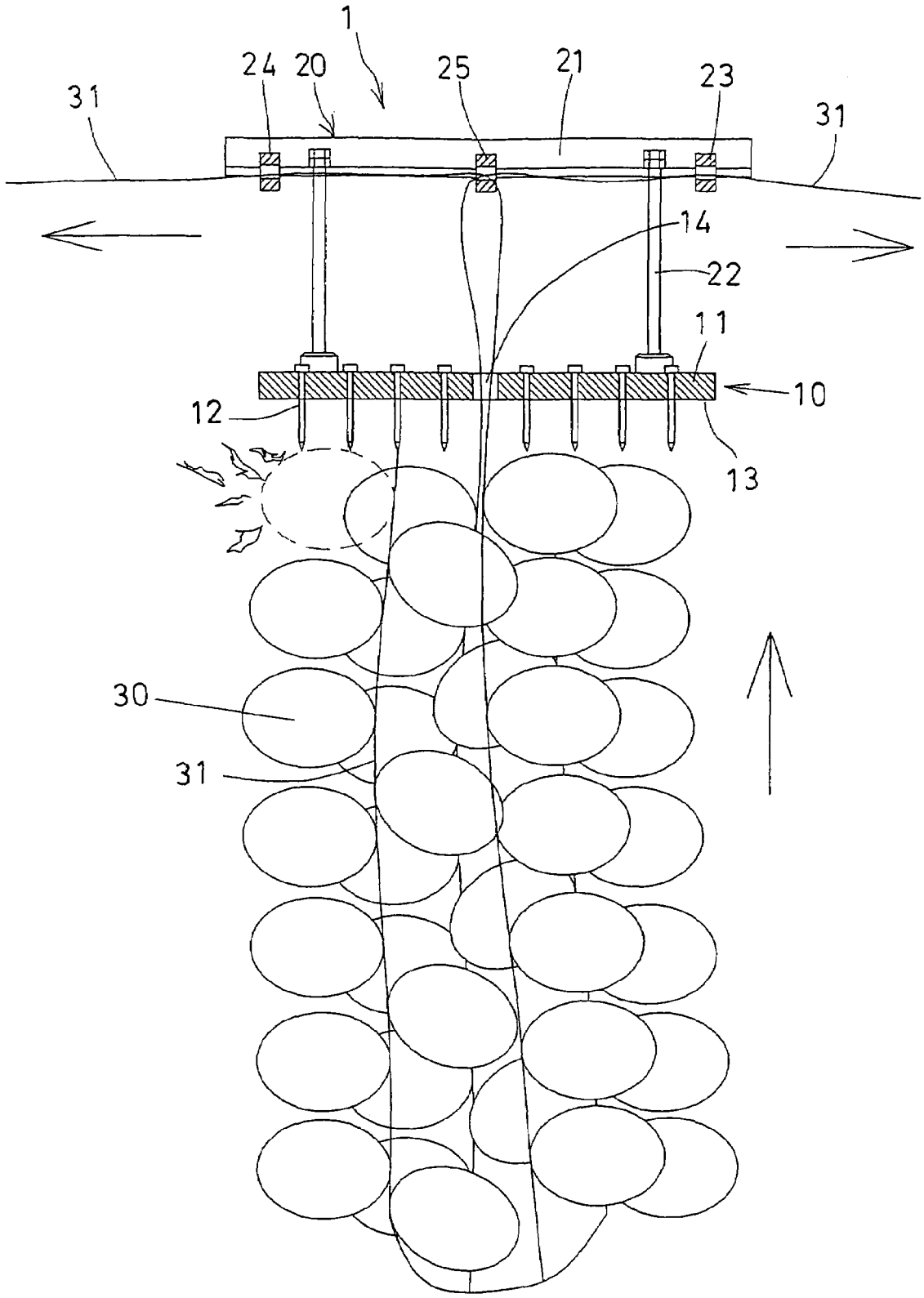
FIG. 4 is a partial cross sectional view similar to FIG. 3, illustrating the operation of the firecracker simulating device.
Figure 5:
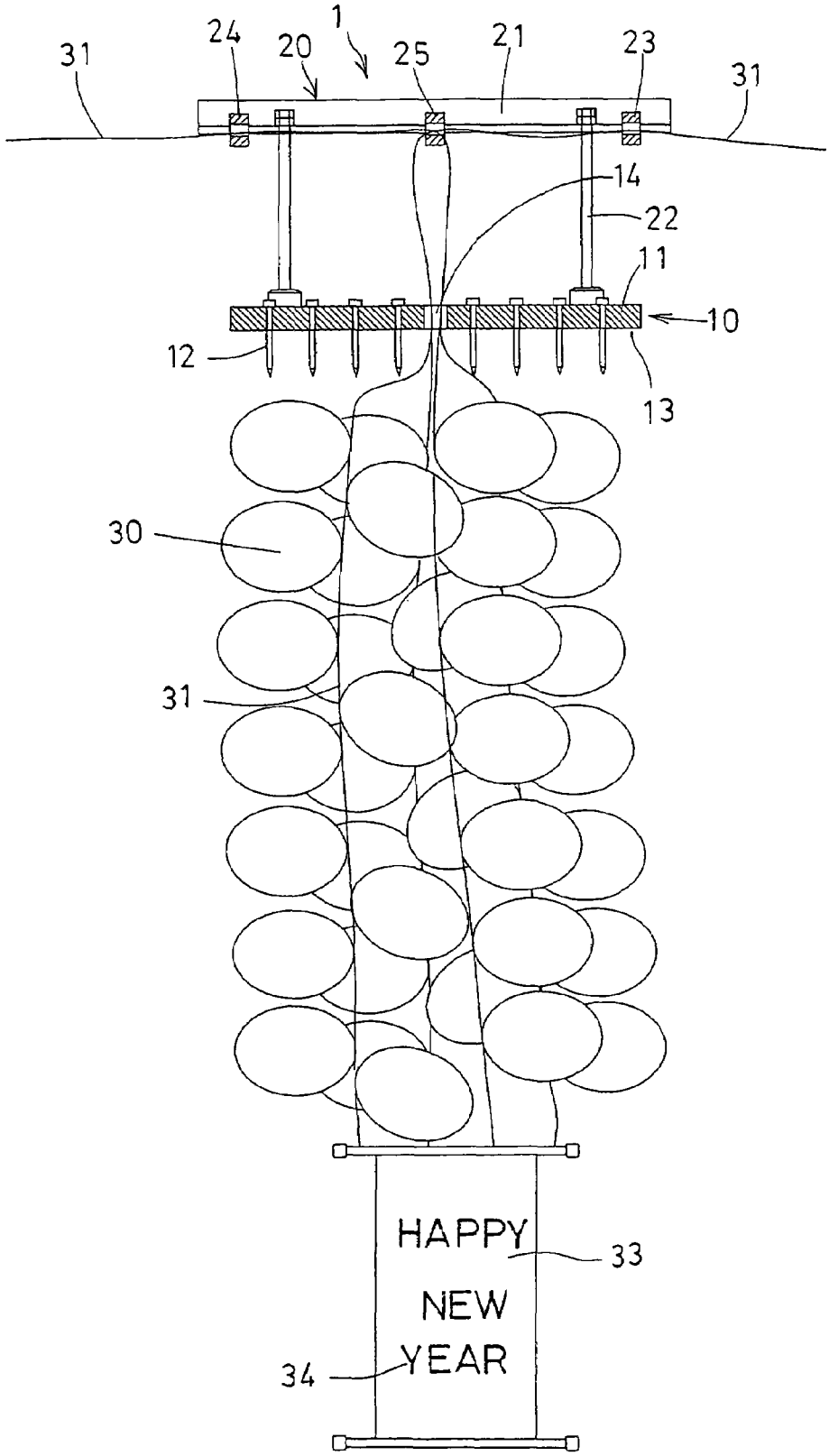
FIG. 5 is another partial cross sectional view similar to FIGS. 3 and 4, illustrating the other arrangement of the firecracker simulating device.

Referring to the drawings, and initially to FIGS. 1-3, a firecracker simulating device 1 in accordance with the present invention comprises a supporting device 10 including a plate 11 having an actuating device 12 or one or more nails or pointed members 12 attached thereto and extended outwardly or upwardly or downwardly beyond the plate 11, such as extended downwardly beyond the bottom surface 13 of the plate 11, best shown in FIGS. 3-5. The plate 11 includes an opening 14 formed therein, such as formed in the middle portion thereof.

A hanging or attaching device 20 may further be provided and attached to the supporting device 10, for attaching or hanging the supporting device 10 to ceilings, walls, or other supporting members (not shown). For example, the attaching device 20 includes a bar 21, such as an angle bar 21 secured or attached to the plate 11 of the supporting device 10 with one or more arms or rods 22, for hanging or attaching to the ceilings, the walls, or the other supporting members. The bar 21 includes one or more rings 23, 24, attached thereto, such as attached to two side portions and an intermediate portion thereof.

A number of balloons 30 are secured or strung together with one or more cables or wires 31, and disposed or arranged in the side or the bottom surface 13 of the plate 11 where the pointed members 12 are extended or protruded outwardly therefrom. The wires 31 are engaged through the middle opening 14 of the plate 11, and may further be engaged through the rings 23, 24, 25 of the bar 21, for being pulled by users (FIG. 4), to move and to force the balloons 30 through the pointed members 12, and thus to allow the balloons 30 to be engaged with and pricked or pierced by the pointed members 12 one by one or in sequence.

The balloons 30 may be exploded when pricked or pierced by the pointed members 12, to generate sounds of explosions that simulate the explosion or firing of the firecrackers without generating smoke or gunpowder and without generating dirt or paper chips or sulphur materials, or poisonous niter materials. The explosion or firing of the balloons 30 may generate explosive sounds that simulate the explosion or firing of the typical firecrackers.

As shown in FIG. 5, a weight member 33 or a billboard or an advertising banner or flag 33 may further be provided and attached to the bottom portion of the wires 31, for straightening the wires 31, and for allowing the balloons 30 to be suitably supported and dependent downwardly from the plate 11 of the supporting device 10. An advertisement 34 or the like may be applied or provided on the flag 33, for example.

It is preferable that the balloons 30 are filled with air or gas that is no lighter than the air, to allow the balloons 30 to be suitably dependent downwardly from the plate 11 of the supporting device 10, without flying upwardly beyond the plate 11, and without the weight or the billboard or the advertising banner or flag 33, or the like.

As shown in FIGS. 1 and 2, for preventing the balloons 30 from flying everywhere after explosion, one or more ribbons 16 may further be provided and attached to the plate 11, and preferably dependent downwardly from the plate 11, and around the plate 11, for suitably engaging with the balloons 30, and for refining and retaining the balloons 30 in place. The ribbons 16 will not influence the explosion of the balloons 30 by the pointed members 12.

It is to be noted that the balloons 30 may be controlled and moved to move through the pointed members 12 by the users, with a suitable or predetermined speed, to allow the balloons 30 to be pricked or pierced by the pointed members 12 in the required speed, and according to the users' need.

Accordingly, the firecracker simulating device in accordance with the present invention may be used for generating explosion or firing of firecrackers without generating smoke or gunpowder and without generating dirt or paper chips or sulphur materials, or poisonous niter materials.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A firecracker simulating device comprising:

a plate including an actuating device attached thereto and extended outwardly therefrom, a plurality of balloons strung together, and means for forcing said balloons to engage with said actuating device, to have said balloons to be pierced by said actuating device, and to generate sounds of explosion;

wherein said forcing means includes a wire to string said balloons together;

the firecracker simulating device further comprising a bar attached to said plate, for attaching said plate to supporting members.

2. The firecracker simulating device as claimed in claim 1, wherein said plate includes an opening formed therein, said wire is engaged through said opening of said plate.

3. The firecracker simulating device as claimed in claim 1, wherein said bar includes a ring attached thereto, said wire is engaged through said ring.

4. The firecracker simulating device as claimed in claim 1, wherein said bar includes at least one rod extended therefrom and secured to said plate.

5. A firecracker simulating device comprising:

a plate including an actuating device attached thereto and extended outwardly therefrom, a plurality of balloons strung together, and means for forcing said balloons to engage with said actuating device, to have said balloons to be pierced by said actuating device, and to generate sounds of explosion;

wherein said forcing means includes a wire to string said balloons together;

the firecracker simulating device further comprising a weight member attached to said wire.

6. The firecracker simulating device as claimed in claim 5, wherein said weight member is a flag.

7. A firecracker simulating device comprising:

a plate including an actuating device attached thereto and extended outwardly therefrom, a plurality of balloons strung together, and means for forcing said balloons to engage with said actuating device, to have said balloons to be pierced by said actuating device, and to generate sounds of explosion;

wherein said forcing means includes a wire to string said balloons together;

the firecracker simulating device further comprising at least one ribbon attached to said plate, and dependent from said plate, and engaged with said balloons, to retain said balloons in place.

* * * * *